United States Patent [19]

Simeth

[11] 4,350,095

[45] Sep. 21, 1982

[54] INK FOUNTAIN ON INKING UNITS OF PRINTING PRESSES

[75] Inventor: Claus Simeth, Offenbach am Main, Fed. Rep. of Germany

[73] Assignee: M.A.N.-Roland Druckmaschinen Aktiengesellschaft, Fed. Rep. of Germany

[21] Appl. No.: 277,954

[22] Filed: Jun. 26, 1981

[30] Foreign Application Priority Data

Jun. 28, 1980 [DE] Fed. Rep. of Germany ..... 3024453

[51] Int. Cl.[3] ..... B41F 31/04; B41F 31/06

[52] U.S. Cl. ..... 101/365

[58] Field of Search ..... 101/365, 169, 157, 363; 118/261; 15/256.51; 101/350, 207, 208, 210

[56] References Cited

U.S. PATENT DOCUMENTS

| | | | |
|---|---|---|---|
| 2,190,929 | 2/1940 | Behrens | 101/365 |
| 2,387,332 | 10/1945 | Kunz | 101/365 |
| 4,058,058 | 11/1977 | Hantscho | 101/365 |
| 4,318,341 | 3/1982 | Pietsch et al. | 101/365 |

FOREIGN PATENT DOCUMENTS

| | | | |
|---|---|---|---|
| 2228625 | 12/1973 | Fed. Rep. of Germany | 101/365 |

*Primary Examiner*—J. Reed Fisher

*Attorney, Agent, or Firm*—Leydig, Voit, Osann, Mayer & Holt, Ltd.

[57] ABSTRACT

An ink fountain formed of a trough and fountain roller, the trough having a recess along its presented edge which defines a ledge surface. A metering bar of durable resilient plastic, and which is of "L" cross section, has a first leg which occupies the recess and a second leg which overlaps, and is sealed to, the bottom of the trough, with the corner of the metering bar defining a gap. Adjusting keys are spaced along the metering bar, each key having a rotatable stem carrying an eccentric at its tip. The first leg of the metering bar has a groove of constant width extending along its inner surface, parallel to the fountain roller, in which all of the eccentrics are snugly received for localized adjustment of the gap, positively in both directions. A resilient sealing strip interposed between the ledge surface and the metering bar seals the second leg of the metering bar with respect to the frame.

11 Claims, 3 Drawing Figures

FIG. 1
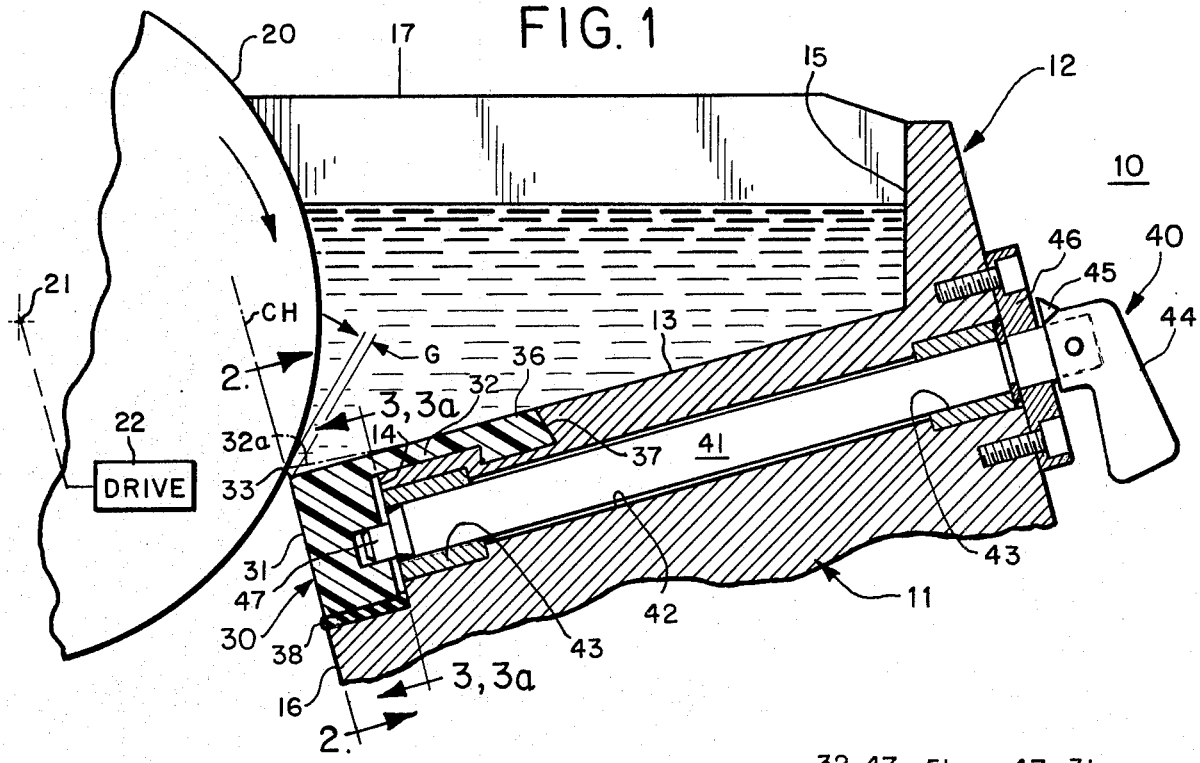
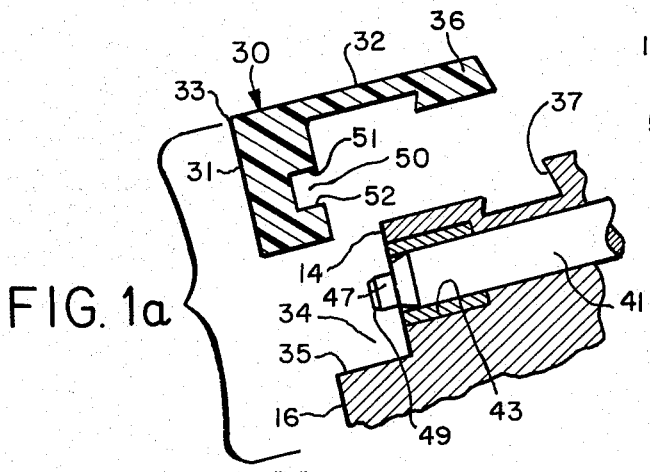
FIG. 1a
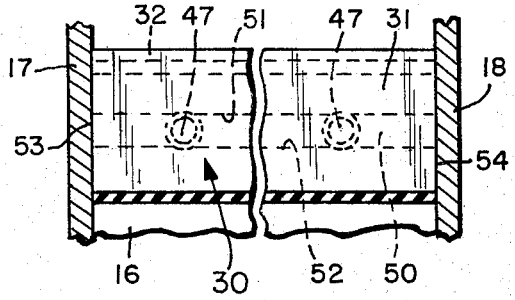
FIG. 2
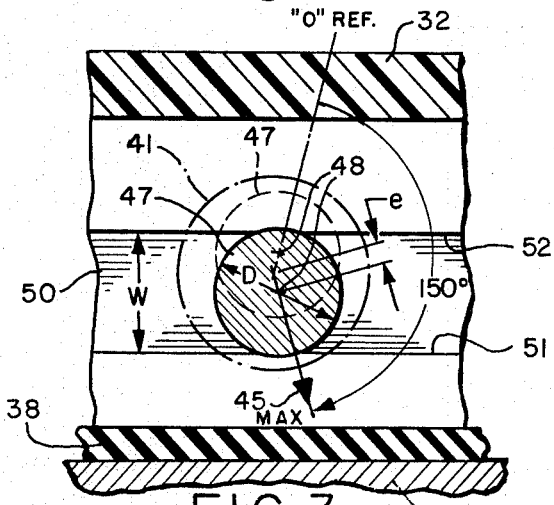
FIG. 3
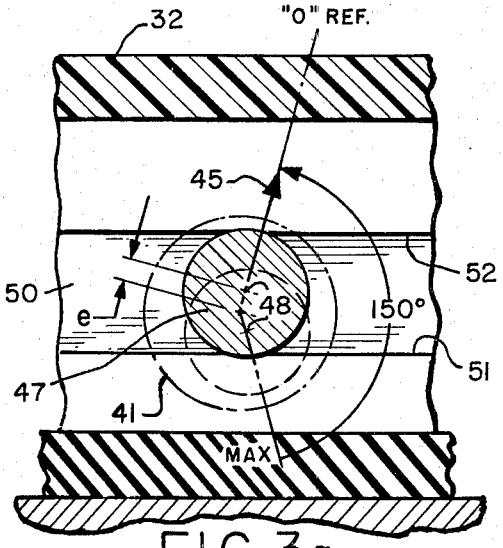
FIG. 3a

INK FOUNTAIN ON INKING UNITS OF PRINTING PRESSES

In a common type of ink fountain ink is contained in a trough, one side of the trough being enclosed by a slowly rotating fountain roller. To control the thickness of the ink film deposited on the roller a continuous flexible fountain blade, usually of metal, is provided which is engaged, on its underside, by a set of adjusting screws, or keys, spaced in column, or zonal, positions. The screws, and the openings in the frame in which the screws are received, must be threaded with high precision. However, even accurately fitted threads have a certain amount of lost motion, or play, so that the adjustment is subject to a hysteresis effect; in other words, the settings are not exactly reproducible. In an effort to remove the effect of play in the thread it has been necessary to make the fountain blade permanently prestressed downwardly against the adjusting screws. This means that local adjustment is positive in only the "closing" direction, with reliance being placed upon the follow-up action of the pre-stress to achieve a desired setting in the "opening" direction. Where ink must be fed at a high rate to satisfy ink requirements in a column position which is flanked by columns having a low ink requirement, it may not be possible to achieve the necessary high rate of feed unless extremely heavy prestress is used or resort is had to a sectioned blade. Moreover, prior inking fountains of the above type are not well shielded against entry of ink and dirt into the mechanism which results in jamming or stickiness so that frequent cleaning is necessary.

It is, accordingly, an object of the present invention to provide an ink fountain having keys for controlling the flow of ink in column, or zonal, positions but which is highly precise, free of any hysteresis effects, so that calibrated settings may be easily and accurately reproduced. In this connection it is an object to provide an ink fountain in which the ink control element, or "blade" is positively moved in both the closing and opening directions unlike arrangements employing conventional adjusting screws where the screw acts in one direction and the blade is pre-tensioned to move, with follow-up action, in the opposite direction. This it is an object to provide an ink fountain in which pre-tensioning is not necessary.

It is a related object of the invention to provide an adjusting arrangement for an ink fountain employing a series of keys spaced in column, or zonal, positions which may be accurately calibrated. In this connection it is an object to provide an adjusting key arrangement for an ink fountain in which the entire range of calibrated flow is achieved with only a limited angle of turning, an angle which is less than 180 degrees and which, for example, may be 150 degrees, resulting in high convenience of adjustment.

It is another object to provide an ink fountain which is simple and highly economical in construction consisting of a metering bar formed of plastic and a set of cooperating keys arranged in column, or zonal, positions, each key consisting of a simple stem with an eccentric at the tip thereof which directly engages a groove in the plastic bar. The stem and the opening in the frame which receives it are both smooth surfaced and neither the stem nor the frame need be expensively threaded. The plastic metering bar may be economically formed by a molding or extruding operation without any subsequent hand work—at most all that is required is cutting to the desired length.

It is yet another object of the invention to provide an ink fountain in which the usual fountain blade is replaced by a plastic metering bar of "L" cross section and which is sealed along both of its edges with respect to the frame, which not only permits use of an extremely simple and positive adjusting mechanism but which protects such adjusting mechanism from entry of dirt or ink. Thus it is an object to provide an ink fountain which is capable of operating for long periods of time without disassembly for the purpose of cleaning the mechanism. Cleaning for the purpose of changing the color of ink is simplified because of the smooth outer surfaces, surfaces which are flush with one another, free of nooks or crannies, and which therefore can be easily wiped clean. Nevertheless the construction may be easily disassembled and re-assembled without necessity for laborious screwing in and out of long threads. Upon re-assembly the reference condition and calibration are automatically re-established without care or attention on the part of the press mechanic.

Other objects and advantages of the inventions will become apparent upon reading the attached detailed description and upon reference to the drawing in which:

FIG. 1 is a transaxial section, in elevation, taken through a fountain employing the present invention.

FIG. 1*a* is a fragmentary exploded view based on FIG. 1.

FIG. 2 is a foreshortened front view in partial section looking along line 2—2 in FIG. 1.

FIG. 3 is a fragmentary section taken through the eccentric tip of the adjusting key and as viewed along line 3—3 in FIG. 1.

FIG. 3*a* is a view corresponding to FIG. 3 but with the eccentric in closed reference position.

While the invention has been described in connection with a preferred embodiment, it will be understood that there is no intention to limit the invention to a particular embodiment but that I intend, on the contrary, to cover the various alternative and equivalent constructions included within the spirit and scope of the appended claims.

Turning now to the drawing there is disclosed, in FIG. 1, an ink fountain 10 having a frame 11 and which includes a trough 12 having a bottom wall 13, a presented edge 14, and a side wall 15. The frame has a flat front surface 16. Abutting the trough at its ends are end walls 17, 18, respectively (see FIG. 2).

Journaled in the frame and, with the trough 12, defining an ink space, is a fountain roller 20 which is rotated slowly in the direction of the arrow about an axis 21. The fountain roller is driven by any desired means from the press drive diagrammatically indicated at 22. As the fountain roller rotates, ink is deposited on the surface of the roller to a thickness which is determined by the width of gap G between the roller and the trough.

In accordance with the invention flow of ink through the gap G is controlled by a metering bar 30 formed of durable resilient plastic of "L" shaped cross section having integral first and second legs. The first, or vertical, leg is indicated at 31 and the second, or horizontal leg at 32. The legs come together at a corner 33 which forms a metering edge defining the gap G.

In accordance with one of the aspects of the present invention the bottom surface of the trough has a recess 34 (see FIG. 1*a*) adjacent its presented edge 14 which is below the axis of rotation 21 of the fountain roller and which defines a ledge surface 35. The first leg 31 of the metering bar is fitted into the recess 34 while the second leg 32 overlaps the bottom 13 of the trough. The bottom surface of the trough is recessed to flushly accommodate the second leg 32 and the remote edge 36 of the second leg is secured to the bottom surface of the trough by providing a dovetailed joint 37 between the two. The latter constitutes an effective seal for the second leg. The first leg is sealed to the frame by means of a resilient sealing strip 38 which is interposed between the ledge surface 35 and the lower edge of the first leg 31.

For the purpose of adjusting the metering bar a plurality of adjusting keys are arranged at spaced intervals, preferably at column, or zonal, positions, along its length, each key having a rotatable stem which is snugly journaled in the frame and which extends through the frame generally parallel to the bottom of the trough to a position adjacent the first leg of the metering bar. The first leg of the metering bar has a groove of constant width extending longitudinally along its inner wall parallel to the fountain roller, and the tip of each rotatable stem is in the form of an eccentric which projects into the groove, and which is closely fitted to the walls of the groove, so that when an adjusting key is rotated the corresponding portion of the metering edge moves chordwise with respect to the fountain roller.

Thus as shown in FIG. 1, a typical key 40 has a rotatable stem 41 which penetrates a bore 42 and which is snugly mounted in sleeve bearings 43 at the ends of the bore. At the outer end of the stem is a handle 44 having a pointer 45. The stem is maintained in its inserted, or seated, position by means of a retainer 46 which is held in place on the frame by screws or the like.

At the tip of the stem is an actuator in the form of an eccentric 47 having an axis 48 which is offset from the axis of rotation of the stem by an amount of eccentricity e (see FIG. 3). The eccentric has a tapered tip 49.

In carrying out the present invention the inner surface of the first leg of the metering bar has a groove 50 of constant width parallel to the fountain roller, with opposed side walls 51, 52 which serve as follower surfaces. Preferably the width W (FIG. 3) between the walls 51, 52 of the groove are spaced at a distance which is just slightly less than the diameter D of the eccentric 47. This provides radial pre-load upon all of the eccentrics to insure against play or lost motion between a key and the metering bar in both directions of adjusting movement.

For the purpose of sealing the ends of the metering bar, which are indicated at 53, 54 (see FIG. 2), the ends are terminated squarely and dimensioned for sealed sliding engagement with the end walls 17, 18 of the trough.

It is one of the features of the construction that the second leg 32 of the metering bar 30 is made of reduced cross section, that is to say, thinner than the first leg 31 to facilitate flexing as the metering bar is moved from the position shown in full lines in FIG. 1 to the position shown by the dot-dashed line 32*a*, which corresponds to the reference condition illustrated in FIG. 3*a*. During the course of adjustment the metering edge 33 moves in a chordwise direction with respect to the fountain roller, that is, along the locus CH.

The plastic of which the metering bar 30 is formed should preferably be durable and wear resisting but having limited stiffness to keep operating forces down on a reasonable level. I prefer to use a plastic which is sufficiently yieldable as to achieve a variation at the gap G between zero and 0.2 mm. without requiring excessive force to be developed at the eccentric. Polyethylene is preferred although polyamids and polyacetals of comparable elasticity may also be used. Preferably the plastic material should have a durometer rating between 75 and 95, on the shore scale.

With regard to the sealing strip 38, this is preferably formed of soft rubber or equivalent having a shore durometer rating between 10 and 20. The material should preferably have a low spring rate which may, if desired, be achieved by employing a rubber foam of the closed cell type which, in addition to providing resilient follow-up with respect to the metering bar, also acts as an effective seal against entry of ink, moisture, dirt or other matter into the eccentric mechanism.

Installation is simple and can be effected by one having little skill or experience. First of all the resilient sealing strip 38 is installed on the ledge 35. The relaxed thickness of the strip should preferably be about 25 to 50 percent greater than the spacing between the first leg of the metering bar and the ledge when the metering bar is in its reference position. Next the metering bar is snapped into place at the dovetail 37 and seated on the resilient strip 38. The stem 41 of a key 40, with the retainer 46 loosely attached, is then inserted into the bore 42. During such insertion the key should preferably be in the vicinity of the midpoint of its range, that is, halfway between the FIG. 3 and FIG. 3*a* positions. While the diameter of the eccentric 47, as mentioned above, slightly exceeds the width of the groove 50, the tapered tip 49 of the eccentric facilitates entry into the groove. As soon as the eccentric has been inserted, the screws associated with the retainer 46 may be turned tight. This process is repeated for each key in the series, that is, for each column position.

The trough is loaded with ink with the keys all in their reference position (FIG. 3*a*) in which the gap G is closed. Subsequently, turning each of the keys clockwise from the reference position permits ink to flow in the corresponding column, or zonal, position depending upon need. As is well known to those skilled in the art, the need for ink, and hence width of gap, is greater in those column positions having large blocks or solidly-printed areas of pigment. The initial setting of the key in each position, depending upon the matter to be printed, is well within the skill of the art as is the touch-up adjustment which is applied after the printing is underway.

As has already been pointed out, most conventional designs of ink fountains of the type employing a continuous blade provide positive adjustment of the blade in the closing direction only, against the force of pre-stress, relying upon such pre-stress to provide follow-up movement of the blade against the tip of the adjusting screw when the adjusting screw is backed off to create a larger gap. However, a problem arises where a given column position requires flow of ink at a high rate whereas the adjacent columns require the gap to be closed down for furnishing of ink at a low rate. Under such conditions the follow-up action provided by the pre-stress is not sufficiently great so as to insure continued contact between the blade and the key which controls it as the key is unscrewed. Loss of contact means that not enough ink will flow in the column which requires it and, in addition, the calibration at the particular column position becomes meaningless.

By contrast using the present adjusting arrangement there is positive control of the gap in each position independently of the setting at an adjacent position and the calibration remains valid at all times. In short, the described construction provides two-way positive adjustment in which the calibration can be relied upon as an accurate measure of the gap. To make the calibration more easily read, it will be apparent that a graduated scale may be provided on the retainer 46 of the pointer 45, and such scale, if desired, may be relatively adjustable to shift the zero reference position back and fourth slightly so that it corresponds to threshold contact between the metering edge 33 and the surface of the fountain roller.

It is one of the features of the construction that the metering bar is of exactly the same cross section along each increment of its length thereby permitting the bar to be extruded or molded at lowest possible cost. However, the term "groove" as used herein is not necessarily limited to a single groove which extends the entire length of the bar but is also applicable to a groove which is discontinuous and which has groove openings only in positions corresponding to the positions of the successive keys. Also while the stem 41 of the key 40 shown in the drawing is parallel to the bottom surface 13 of the trough, it will be understood that this is not necessary for a practical device and that it suffices if the two elements are generally parallel, that is, extend in the same general direction.

It is one of the features of the construction that the eccentric 47 is integral with the stem 41. It is not necessary that the two be made of the same piece of metal; indeed, the term "eccentric" will be understood by one skilled in the art to include a cam or cranked connection.

Indeed, rather substantial changes may be made in the construction without departing from the broader aspects of the present invention. For example, for additional flexibility of the metering bar, particularly when using nylon or other relatively stiff kinds of plastic, the first, or vertical, leg of the metering bar may be provided with transverse upwardly extending slits, for example, at the points of division between adjacent column positions, each slit extending, if desired, to the level of the second leg 32. Where such slitting is done the slits may be filled with sealing strips such as the strip 38 made of a material having a low spring rate in order to prevent inward leakage of ink into the adjusting mechanism. Also while it is preferred that the eccentric actuator 47 have a "form fit" with respect to the groove 50, with the eccentric pressing against both of the opposed walls, the groove cam, if desired, be made of greater width so that the eccentric bears only against the lowermost wall 51, with reliance then being placed upon the resilient strip 38 to provide the necessary bias to keep the eccentric and its follower surface in constant contact throughout the range of adjustment.

In accordance with one of the more detailed features of the invention the front surface 16 of the frame is designed to be flush with the front surface of the first leg 31 of the metering bar. Moreover, the bottom of the trough is preferably recessed, as shown, to flushly accommodate the second leg 32 of the metering bar. Thus both of the presented surfaces of the metering bar constitute a smooth continuation of the respective adjacent surfaces thereby to facilitate cleaning of the fountain required by change in color, with the metering bar being sealed, with respect to the frame, by the dovetailed joint 37 and resilient sealing strip 38 respectively.

What I claim is:

1. In an ink fountain for a printing press, the combination comprising a frame including a trough, a fountain roller journaled in the frame, the trough and the fountain roller together defining an ink space, means for rotating the fountain roller slowly in the direction of the bottom of the trough, the bottom surface of the trough having a recess along its presented edge which is below the axis of rotation of the fountain roller and which defines a downwardly spaced ledge surface on the frame, a metering bar formed of durable resilient plastic of "L" shaped cross section having integral first and second legs, the first leg occupying the recess with the corner of the "L" closely spaced parallel to the surface of the fountain roller to form a metering edge defining a gap, the second leg overlapping the bottom of the trough and secured to the bottom of the trough along its remote edge, a plurality of adjusting keys at spaced intervals along the metering bar, each key having a rotatable stem snugly journaled in the frame and which extends through the frame generally parallel to the bottom of the trough to a position adjacent the first leg of the metering bar, the first leg of the metering bar having a groove of constant width extending longitudinally along its inner wall parallel to the fountain roller, the tip of each rotatable stem being in the form of an eccentric which projects into the groove and which is closely fitted to the walls of the groove so that when an adjusting key is rotated the corresponding portion of the metering edge moves chordwise with respect to the fountain roller for localized adjustment of the width of the gap, and a resilient sealing strip interposed between the ledge surface and the first leg of the metering bar to follow the adjusting movement of the latter while sealing the metering bar with respect to the frame.

2. In an ink fountain for a printing press the combination comprising a frame including a trough, a fountain roller journaled in the frame, the trough and fountain roller together defining an ink space, means for rotating the fountain roller slowly in the direction of the bottom of the trough, the bottom surface of the trough having a presented edge which is parallel to and spaced from the surface of the fountain roller to define an intervening space below the axis of rotation of the fountain roller, a metering bar formed of durable resilient plastic of "L" shaped cross section having integral first and second legs, the first leg occupying the intervening space with the corner of the "L" closely spaced parallel to the surface of the fountain roller to form a metering edge defining a gap, the second leg overlapping the bottom of the trough and secured to the bottom of the trough along its remote edge, a plurality of adjusting keys at spaced intervals along the metering bar, each key having a stem snugly journaled in the frame and which extends through the frame generally parallel to the bottom of the trough to a position adjacent the first leg of the metering bar, the first leg of the metering bar having a groove of constant width extending longitudinally along its inner wall parallel to the fountain roller, the tip of each rotatable stem being in the form of an eccentric which projects into the groove, the groove presenting a follower surface in contact with the eccentric so that when each adjusting key is rotated the corresponding portion of the metering edge moves chordwise with respect to the fountain roller for localized adjustment of the width of the gap, the second leg of the metering bar having a reduced cross section for flexing to accommodate the throw of the eccentric.

3. In an ink fountain for a printing press the combination comprising a frame including a trough, a fountain roller journaled journaled in the frame, the trough and fountain roller together defining an ink space, means for rotating the fountain roller slowly in the direction of the bottom of the trough, the bottom surface of the trough having a presented edge which is parallel to and spaced from the surface of the fountain roller to define an intervening space below the axis of rotation of the fountain roller, a metering bar formed of durable resilient plastic of "L" shaped cross section having integral first and second legs, the first leg occupying the intervening space with the corner of the "L" closely spaced parallel to the surface of the fountain roller to form a metering edge defining a gap, the second leg overlapping the bottom of the trough and secured to the bottom of the trough along its remote edge, a plurality of adjusting keys at spaced intervals along the metering bar, each key having a stem snugly journaled in the frame and which extends through the frame generally parallel to the bottom of the trough to a position adjacent the first leg of the metering bar, the first leg of the metering bar having a groove of constant width extending longitudinally along its inner wall parallel to the fountain roller, the tip of each rotatable stem being in the form of an eccentric which projects into the groove and which is closely fitted to the parallel walls of the groove so that when each adjusting key is rotated in either direction the corresponding portion of the metering edge moves chordwise with respect to the fountain roller to adjust the width of the gap.

4. In an ink fountain for a printing press the combination comprising a frame including a trough, a fountain roller journaled in the frame, the trough and the fountain roller together defining an ink space, means for rotating the fountain roller slowly in the direction of the bottom of the trough, the bottom surface of the trough having a recess along its presented edge which is below the axis of rotation of the fountain roller and which defines a downwardly spaced ledge surface on the frame, a metering bar formed of durable resilient plastic of "L" shaped cross section having integral first and second legs, the first leg occupying the recess with the corner of the "L" closely spaced parallel to the surface of the fountain roller to form a metering edge defining a gap, the second leg overlapping the bottom of the trough and secured to the bottom of the trough along its remote edge, a plurality of adjusting keys at spaced intervals along the metering bar, each key having a rotatable stem snugly journaled in the frame and which extends through the frame generally parallel to the bottom of the trough to a position adjacent the first leg of the metering bar, the tip of each rotatable stem having an eccentric surface thereon, the first leg of the metering bar having a follower surface which engages the eccentric surface so that when the adjusting key is rotated the metering edge moves chordwise with respect to the fountain roller to adjust the width of the gap, the second leg of the metering bar having a reduced cross section for flexing to accommodate the throw at the eccentric surface, and a strip of resilient material interposed between the ledge surface and the first leg of the metering bar to follow the adjusting movement of the latter.

5. In an ink fountain for a printing press the combination comprising a frame including a trough, a fountain roller journaled in the frame, the trough and the fountain roller together defining an ink space, means for rotating the fountain roller slowly in the direction of the bottom of the trough, the bottom surface of the trough having a recess along its presented edge which is below the axis of rotation of the fountain roller and which defines a downwardly spaced ledge surface on the frame, a metering bar formed of durable resilient plastic of "L" shaped cross section having integral first and second legs, the first leg occupying the recess with the corner of the "L" closely spaced parallel to the surface of the fountain roller to form a metering edge defining a gap, the second leg overlapping the bottom of the trough and secured to the bottom of the trough along its remote edge, a plurality of adjusting keys at spaced intervals along the metering bar, each key having a rotatable stem snugly journaled in the frame and which extends through the frame generally parallel to the bottom of the trough to a position adjacent the first leg of the metering bar, each rotatable stem having an actuator at its tip which moves relatively at right angles to the axis of the stem as the stem is turned, the first leg of the metering bar having a pair of follower surfaces which pressingly grip each actuator so that when an adjusting key is rotated to opposite directions the metering edge moves chordwise with respect to the fountain roller free of lost motion to respectively increase and decrease the width of the gap.

6. In an ink fountain for a printing press the combination comprising a frame including a trough, a fountain roller journaled in the frame, the trough and the fountain roller together defining an ink space, means for rotating the fountain roller slowly in the direction of the bottom of the trough, the bottom surface of the trough having a presented edge which is parallel to and spaced from the surface of the fountain roller to define an intervening space below the axis of rotation of the fountain roller, a metering bar formed of durable resilient plastic of "L" shaped cross section having integral first and second legs, the first leg occupying the intervening space with the corner of the "L" closely spaced parallel to the surface of the fountain roller to form a metering edge defining a gap, the second leg overlapping the bottom of the trough and secured to the bottom of the trough along its remote edge, a plurality of adjusting keys at spaced intervals along the metering bar, each key having a rotatable stem snugly journaled in the frame and which extends through the frame generally parallel to the bottom of the trough to a position adjacent the first leg of the metering bar, each rotatable stem having an eccentric at its tip, the first leg of the metering bar having opposed follower surfaces which are closely fitted to each eccentric to hold the eccentric snugly between them so that when an adjusting key is rotated the corresponding portion of the metering edge moves chordwise with respect to the fountain roller to adjust the localized width of the gap.

7. In an ink fountain for a printing press the combination comprising a frame including a trough, a fountain roller journaled in the frame, the trough and the fountain roller together defining an ink space, means for rotating the fountain roller slowly in the direction of the bottom of the trough, the bottom surface of the trough having a presented edge which is parallel to and spaced from the surface of the fountain roller to define an intervening space below the axis of rotation of the fountain roller, a metering bar formed of durable resilient plastic of "L" shaped cross section having integral first and second legs, the first leg occupying the intervening space with the corner of the "L" closely spaced parallel to the surface of the fountain roller to form a metering edge defining a gap, the second leg overlapping the bottom of the trough and secured to the bottom of the trough along its remote edge, a plurality of adjusting keys at spaced intervals along the metering bar, each key having a rotatable stem snugly journaled in the frame and which extends through the frame generally parallel to the bottom of the trough to a position adjacent the first leg of the metering bar, the tip of each rotatable stem having an eccentric surface thereon, the first leg of the metering bar having a follower surface which engages the eccentric surface so that when an adjusting key is rotated the corresponding portion of the metering edge moves chordwise with respect to the fountain roller to adjust the localized width of the gap, the second leg of the metering bar having a reduced cross section for flexing to accommodate the throw at the eccentric surface.

8. The combination as claimed in claim 1 or claim 2 or claim 3 or claim 4 or claim 5 or claim 6 or claim 7 in which the bottom of the trough is recessed to flushly accommodate the second leg of the metering bar and in which the remote edge of the second leg has a longitudinally extending dovetail connection with the bottom surface of the trough.

9. The combination as claimed in claim 1 or claim 2 or claim 3 or claim 4 or claim 5 or claim 6 or claim 7 in which the frame includes parallel end walls for enclosing the ends of the trough and in which the metering bar has an identical cross section and is smoothly continuous throughout its entire length, the ends of the bar being in sealed sliding engagement with the end walls.

10. The combination as claimed in claim 1 or claim 2 or claim 3 in which the walls of the groove are spaced apart by a distance which is slightly less than the diameter of the eccentrics to provide radial preload upon the eccentrics to insure against play or lost motion between a key and the metering bar in both directions of adjusting movement.

11. The combination as claimed in claim 1 or claim 4 or claim 5 in which the frame has a front surface under the ledge surface and which extends generally perpendicularly to the bottom surface of the trough, the first leg of the metering bar being substantially flush with the front surface of the frame, the bottom of the trough being recessed to flushly accommodate the second leg of the metering bar so that the metering bar constitutes a smooth continuation of the respective adjacent surfaces thereby to facilitate cleaning of the fountain required by change in color, the metering bar being sealed, along both of its remote edges, with respect to the frame.

* * * * *